US009177536B1

(12) United States Patent
Chang

(10) Patent No.: US 9,177,536 B1
(45) Date of Patent: Nov. 3, 2015

(54) STRING ADJUSTMENT APPARATUS

(71) Applicant: PING WELL INDUSTRIAL CO., LTD., Taichung (TW)

(72) Inventor: Tsung-Min Chang, Taichung (TW)

(73) Assignee: PING WELL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 14/509,668

(22) Filed: Oct. 8, 2014

(51) Int. Cl.
*G10D 3/14* (2006.01)

(52) U.S. Cl.
CPC ..... *G10D 3/14* (2013.01)

(58) Field of Classification Search
CPC ..... G10D 3/14; G10D 3/143; G10D 3/10; G10D 3/006; G10D 1/00
USPC ..... 84/290, 297 R, 304–305
See application file for complete search history.

(56) References Cited

U.S. PATENT DOCUMENTS 4,860,627 A * 8/1989 Sloane ..... G10D 3/14 84/306
6,989,482 B2 * 1/2006 Goto ..... G10D 3/14 84/304

* cited by examiner

*Primary Examiner* — Kimberly Lockett
(74) *Attorney, Agent, or Firm* — Muncy, Geissler, Olds & Lowe, P.C.

(57) ABSTRACT

A string adjustment apparatus includes an outer shell, an adjustment stem member, a winding shaft member and a base. The outer shell includes a housing recess and a recess opening. The adjustment stem member includes a stem and a turning peg. The winding shaft member includes a shaft, a worm gear portion and a string hole portion. The base includes a plate corresponding to the recess opening and a first tube extended from the plate towards a direction remote from the outer shell. The worm gear portion and the stem are located in the housing recess and coupled with each other. The shaft runs through the first tube to make the string hole portion to pass through the first tube and also make the plate to cover the recess opening. Thus, a simpler structure is formed to make assembly easier.

6 Claims, 6 Drawing Sheets

STRING ADJUSTMENT APPARATUS

FIELD OF THE INVENTION

The present invention relates to a stringed instrument structure and particularly to a string adjustment apparatus that is simply structured and can be assembled easily.

BACKGROUND OF THE INVENTION

Please referring to FIG. 1, a conventional stringed instrument such as a guitar has a string winding means located thereon to adjust the looseness and tightness of strings. Also referring to FIG. 2, the conventional string winding means of a guitar includes a hollow seat 1 and a duct extended longitudinally from the bottom of the seat 1 to couple with a winding shaft 2. The winding shaft 2 has an upper end engaged with a worm gear 3 located in the seat 1 and a string hole at a lower side threaded through by a string for fastening. The seat 1 has a transverse axle duct 4 run through by a worm 5 which is engaged with the worm gear 3 to drive the worm gear 3 to turn. The worm 5 has a coupling portion 5*a* at one end with two opposite flat surfaces, a turning peg 6 with a hole formed in the center that also has two flat surfaces opposing each other to couple with the coupling portion 5*a*, a screw 5*b* fastened from outside to a screw hole formed in the coupling portion 5*a* to fixed the turning peg 6 on the worm 5. The winding shaft 2 has a screw hole 2*a* in the center of an upper end thereof fastened by another screw 7 to form secure positioning of the winding shaft 2. The seat 1 further has an opening 8 at the top covered by a sealing lid 9.

By turning the turning peg 6 to drive the worm 5 to turn in a positive direction or a negative direction the worm gear 3 can be turned in the positive direction or the negative direction, and the winding shaft 2 also can be turned in the positive direction or the negative direction, thereby the looseness or tightness of the strings of the guitar can be adjusted as desired.

However, the conventional string adjustment means of guitars consists of a great number of structural elements, and the winding shaft 2 and the worm gear 3 have to be fabricated separately. Moreover, the turning shaft 2 has to be coupled on the seat 1 by fastening the screw 7 at two ends of the duct, and to avoid the screw 7 from exposing that could spoil the appeal the opening 8 has to be covered by the sealing lid 9, all this requires extra elements and results in a higher cost. Moreover, the complicated structure makes assembly through automation equipment impossible, and manual assembly has to be adopted. This further increases the cost. Hence the selling price also is higher that seriously affects competitiveness on the market.

SUMMARY OF THE INVENTION

The primary object of the present invention is to reduce structural elements and lower production cost.

To achieve the foregoing object the present invention provides a string adjustment apparatus that includes an outer shell, an adjustment stem member, a winding shaft member and a base. The outer shell includes a housing recess and a recess opening. The adjustment stem member includes a stem run through the housing recess and a turning peg located at one end of the stem. The winding shaft member includes a shaft, a worm gear located at one end of the shaft and a string hole portion at another end of the shaft remote from the worm gear. The base corresponds to the outer shell and includes a plate corresponding to the recess opening and a first tube extended from the plate remote from the outer shell.

The worm gear is located in the housing recess and coupled with the stem. The shaft runs through the first tube so that the plate can cover and seal the recess opening, and also makes the string hole portion to run through one end of the first tube remote from the plate.

For assembly of the string adjustment apparatus, first, have the adjustment stem member run through the outer shell to place the stem in the housing recess; next, place the winding shaft member into the housing recess through the recess opening to couple the worm gear with the stem; then couple the first tube of the base from one end of the string hole portion of the winding shaft member on the shaft so that the plate seals the recess opening and the string hole portion runs through from one end the first tube remote from the plate; thus finish assembly of the string adjustment apparatus.

The string hole portion allows a string to thread through. For adjusting the looseness and tightness of the string, turn the turning peg to drive the stem to turn, then the worm gear is driven to turn that in turn drive the shaft turning, hence the string hole portion also is turned to tighten or loosen the string to adjust the tightness or looseness of the string as desired.

Through the structure set forth above, the invention can provide features as follows:

1. By collaborating the outer shell, the winding shaft member and the base in assembly, the number of structural elements can be reduced to lower production cost.

2. The outer shell, the winding shaft member and the base also can be formed integrally to make assembly simpler, hence can facilitate automatic assembly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
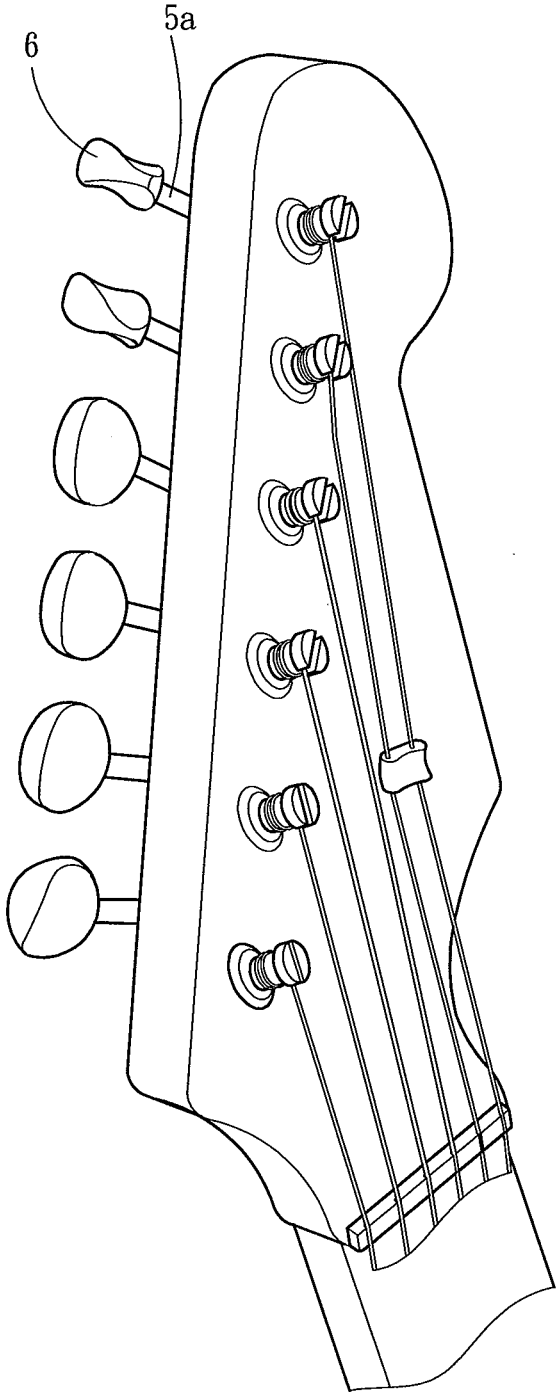
Fig. 1 PRIOR ART
FIG. 1 is a schematic view of a conventional guitar string winding apparatus.
Figure 2:
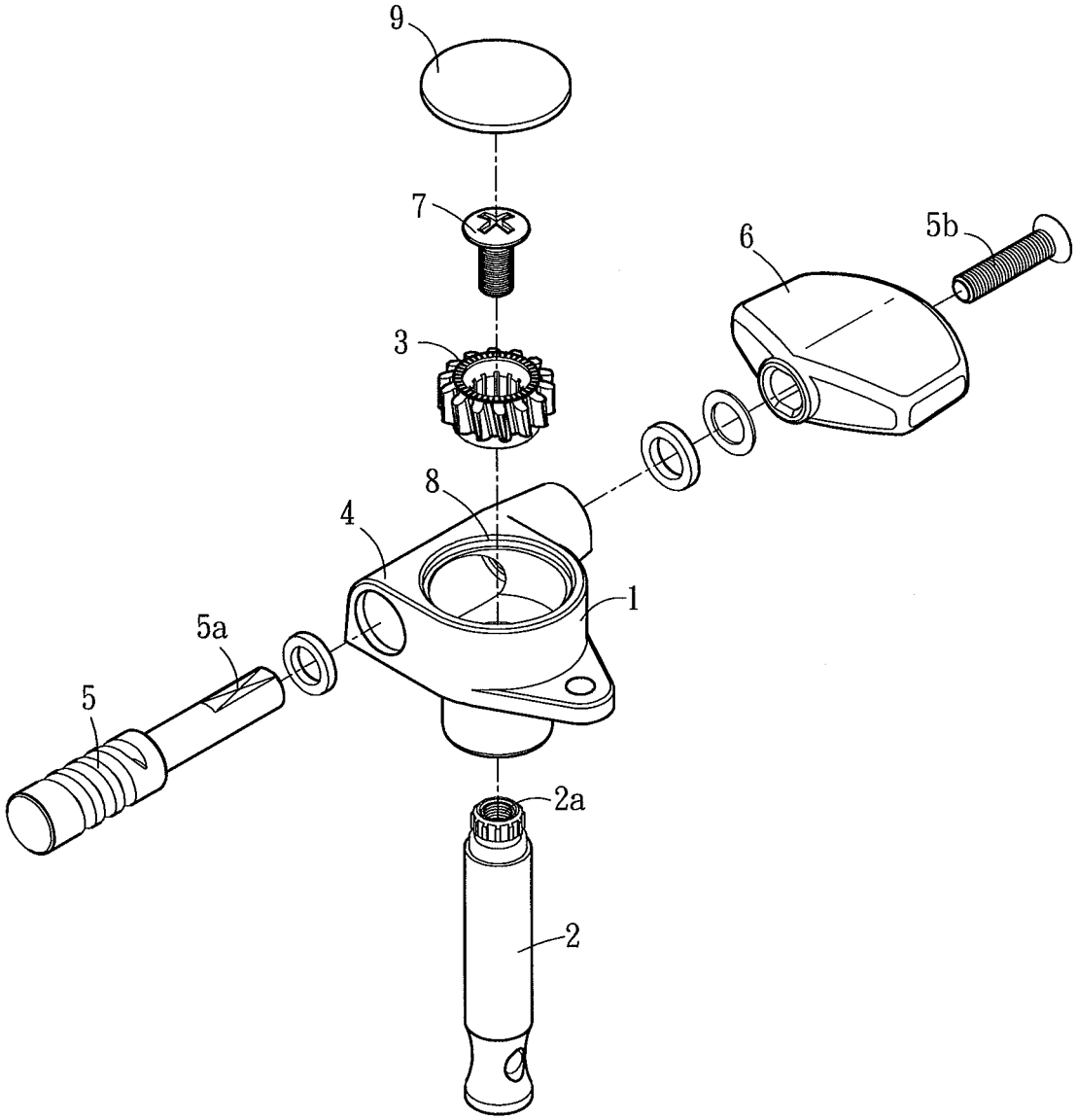
Fig. 2 PRIOR ART
FIG. 2 is an exploded view of a conventional guitar string winding apparatus.
Figure 3:
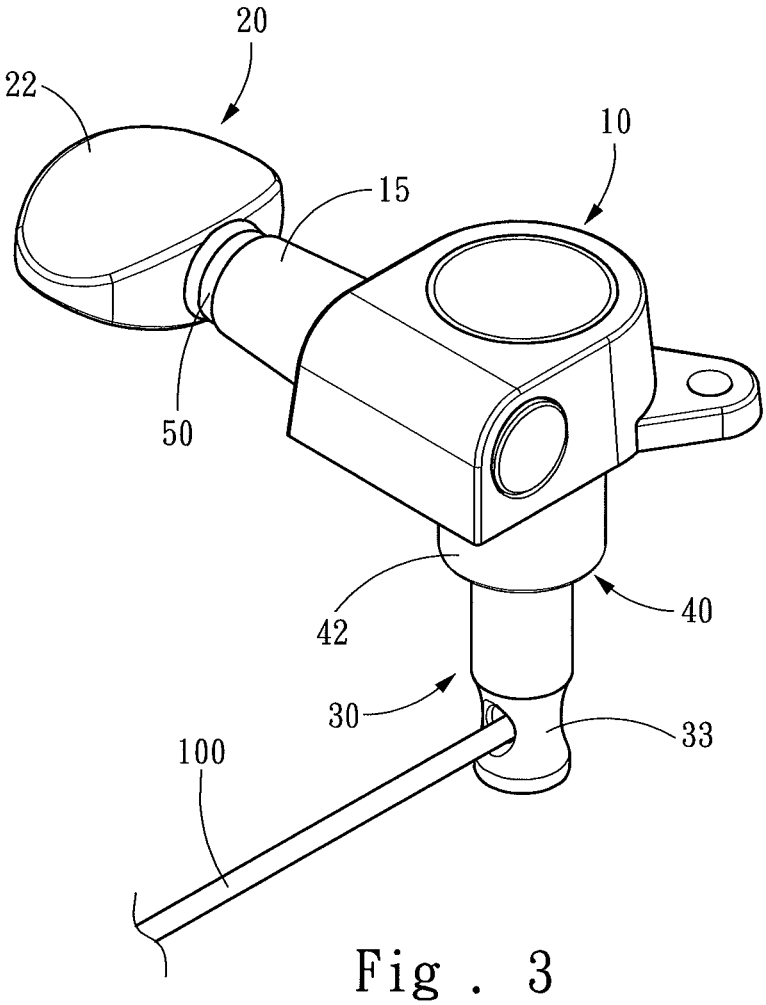
FIG. 3 is a perspective view of the invention.
Figure 4:
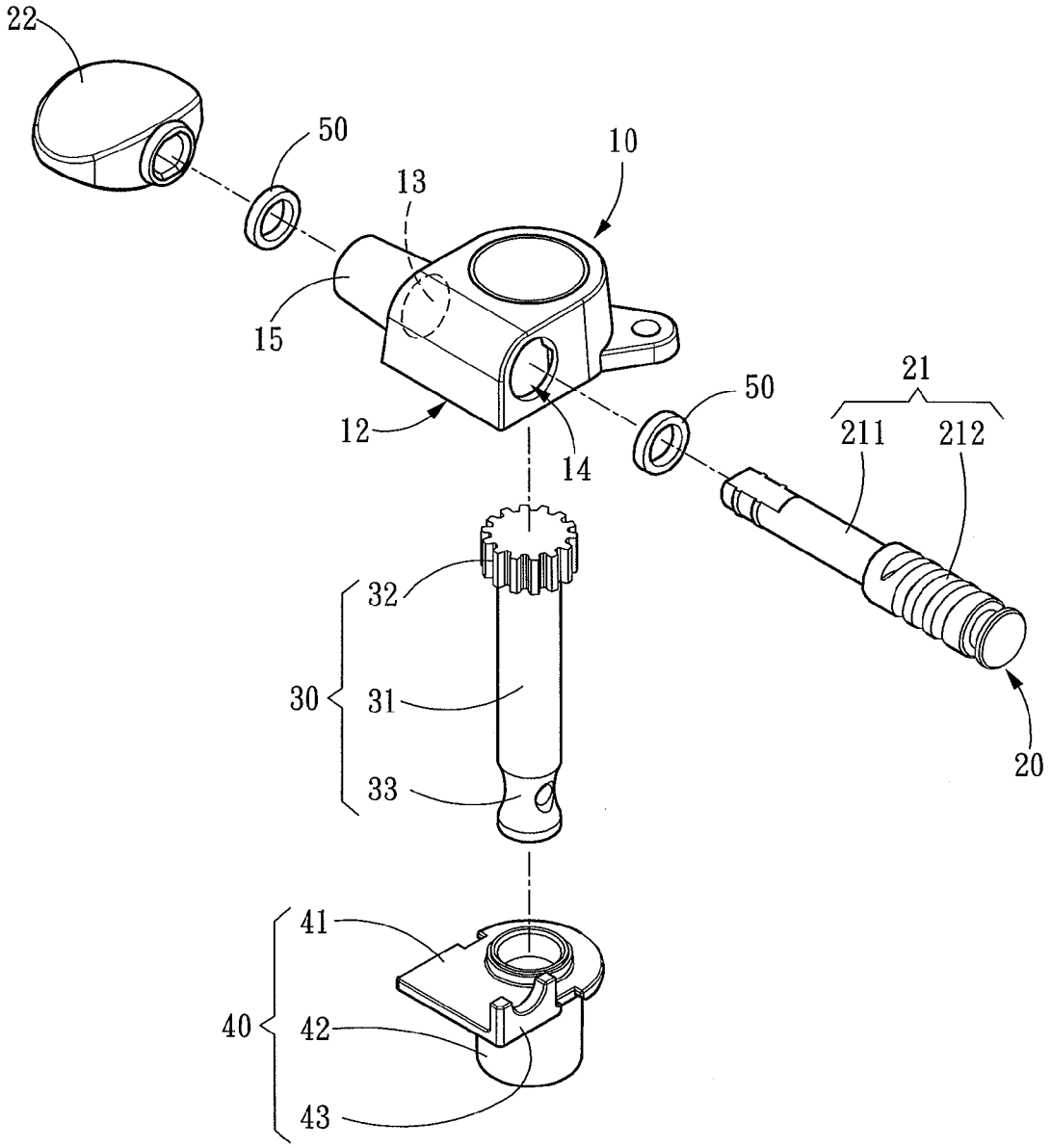
FIG. 4 is an exploded view of an embodiment of the invention.
Figure 5:
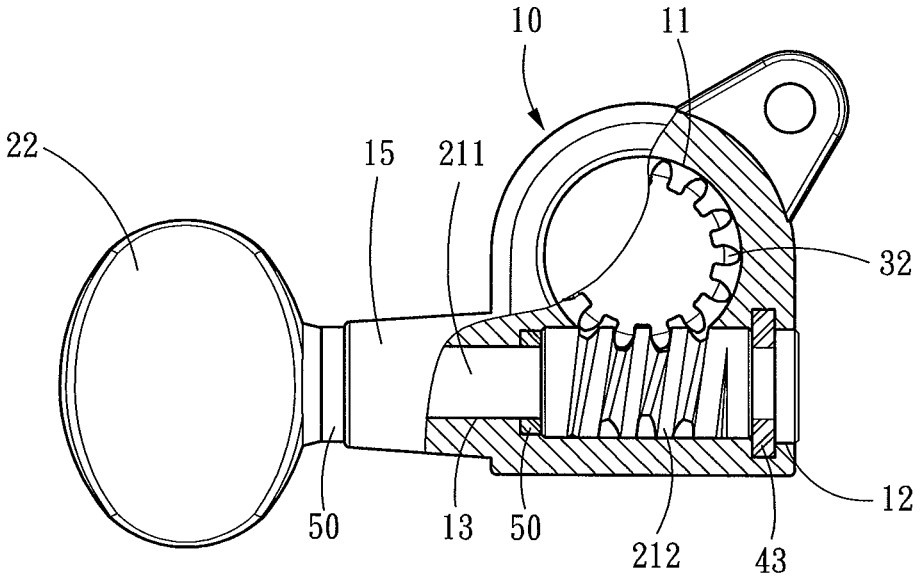
FIG. 5 is a fragmentary sectional view of an embodiment of the invention.

Please referring to FIGS. 3, 4 and 5, the present invention aims to provide a string adjustment apparatus that includes an outer shell 10, an adjustment stem member 20, a winding shaft member 30 and a base 40. The outer shell 10 includes a housing recess 11, a recess opening 12, a first hole 13, a second hole 14 corresponding to the first hole 13 and a second tube 15 located around the first hole 13 and extended in a direction remote from the outer shell 10. The adjustment stem member 20 includes a stem 21 run through the housing recess 11 and a turning peg 22 located at one end of the stem 21. The stem 21 includes a connecting section 211 connected to the turning peg 22 and a worm thread section 212 connected to one end of the connecting section 211 remote from the turning peg 22. The winding shaft member 30 includes a shaft 31, a worm gear 32 located at one end of the shaft 31 and a string hole portion 33 at another end of the shaft 31 remote from the worm gear 32. The base 40 corresponds to the outer shell 10 and includes a plate 41 corresponding to the recess opening 12 and a first tube 42 extended from the plate 41 remote from the outer shell 10.

The stem 21 runs through the first hole 13 and the second hole 14 to couple with the turning peg 22 so that the adjustment stem member 20 runs through the outer shell 10 with the connecting section 211 running through and held in the second tube 15. The worm thread section 212 is located in the housing recess 11. The worm gear 32 is located in the housing recess 11 and engaged with the worm thread section 212 of the stem 21 so that the adjustment stem member 20 and the winding shaft member 30 can be moved related to each other. The first tube 42 of the base 40 is coupled on the shaft 31 with the string hole portion 33 running through one end of the first tube 42 remote from the plate 41. The plate 41 covers the recess opening 12.

Figure 6:
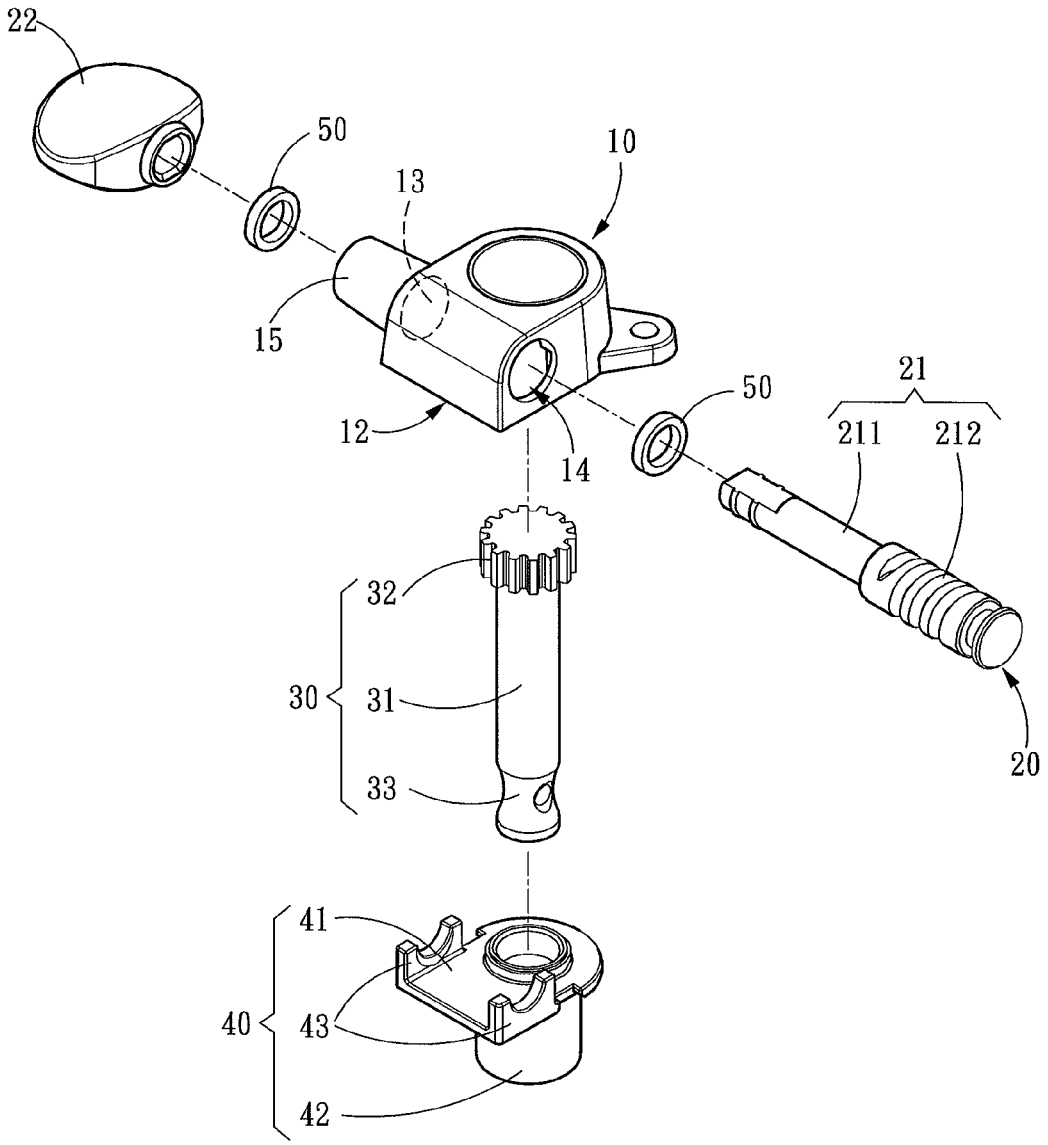
FIG. 6 is an exploded view of another embodiment of the invention.

Also referring to FIG. 4, in this embodiment the base 40 further includes a clamp portion 43 extended from the plate 41 toward the outer shell 10. The clamp portion 43 clamps one end of stem 21 where the worm thread section 212 is formed so that the adjustment stem member 20 can securely run through the outer shell 10 to enhance stability thereof. In addition, referring to FIG. 6 for another embodiment, the clamp portion 43 includes two sets to clamp two ends of the worm thread section 212 to further enhance the stability of the adjustment stem member 20. Moreover, the string adjustment apparatus further includes two fixed washers 50 that are coupled on the stem 21 at two ends of the second tube 15.

For assembly of the string adjustment apparatus, first, have the adjustment stem member 20 run through the first hole 13, the second hole 14, the second tube 15 and the two fixed washers 50, and couple one end of the connecting section 211 remote from the worm thread section 212 with the turning peg 22 to place the worm thread section 212 in the housing recess 11; next, place the winding shaft member 30 into the housing recess 11 through the recess opening 12 to engage the worm gear 32 with the worm thread section 212, then couple the first tube 42 from one end of the string hole portion 33 of the winding stem set 30 on the shaft 31 so that the plate 41 seals the recess opening 12, meanwhile the two clamp portion 43 clamp two ends of the worm thread section 212 while the string hole portion 33 running through one end of the first tube 42 remote from the plate 41, thus finish assembly of the string adjustment apparatus.

Also referring to FIG. 3, the string hole portion 33 allows a string 100 to thread through. For adjusting the looseness and tightness of the string 100, turn the turning peg 22 to drive the stem 21 to turn, the worm thread section 212 drives the worm gear 32 turning so that the shaft 31 also turns, then the string hole portion 33 is driven to loosen or tighten the string 100, thereby the looseness or tightness of the string 100 can be adjusted as desired. In addition, through the two fixed washers 50 the adjustment stem member 20 can be prevented from causing friction on the outer shell 10 during operation, also avoid the adjustment stem member 20 from turning in reverse than might cause loosening thereof to prevent the string 100 from loosening that might affect accuracy of the tone.

As a conclusion, the invention can provide features as follows:

1. By collaborating the outer shell, the winding shaft member and the base in assembly, the number of structural elements can be reduced to lower production cost.

2. The outer shell, the winding shaft member and the base also can be formed integrally to make assembly simpler, hence can facilitate automatic assembly.

3. Through the second tube and the two clamp portions the steadiness of the adjustment stem member during adjustment of the string can be enhanced without affecting accuracy of the tone.

4. Through the two fixed washers not only damage of the outer shell caused friction during movement of the adjustment stem member that might otherwise happen can be avoided, turning reverse and loosening of the adjustment stem member also can be prevented, hence loosening of the string can be averted to prevent affecting the accuracy of the tone.

What is claimed is:

1. A string adjustment apparatus, comprising:

an outer shell including a housing recess and a recess opening;

an adjustment stem member including a stem run through the housing recess and a turning peg located at one end of the stem;

a winding shaft member including a shaft, a worm gear portion located at one end of the shaft and a string hole portion located at another end of the shaft remote from the worm gear; and a base corresponding to the outer shell and including a plate corresponding to the recess opening and a first tube extended from the plate towards a direction remote from the outer shell;

wherein the worm gear portion is located in the housing recess and coupled with the stem, the shaft running through the first tube to make the plate to cover the recess opening and also make the string hole portion to run through one end of the first tube remote from the plate.

2. The string adjustment apparatus of claim 1, wherein the outer shell further includes a first hole, a second hole corresponding to the first hole and a second tube formed around the first hole and extended in a direction remote from the outer shell.

3. The string adjustment apparatus of claim 2, wherein the stem includes a connecting section connected to the turning peg and a worm thread section connected to one end of the connecting section remote from the turning peg and engaged with the worm gear portion, the stem running through the first hole and the second hole to allow the connecting section to pass through the second tube and the worm thread section to be located in the housing recess.

4. The string adjustment apparatus of claim 3, wherein the base further includes a clamp portion which is extended from the plate toward the outer shell to clamp one end of the worm thread section.

5. The string adjustment apparatus of claim 3, wherein the base further includes two clamp portions which are extended from the plate toward the outer shell to clamp two ends of the worm thread section respectively.

6. The string adjustment apparatus of claim 3 further includes two fixing washers coupled on the stem and located at two ends of the second tube.

* * * * *